US007476165B2

(12) United States Patent
Boesch

(10) Patent No.: US 7,476,165 B2
(45) Date of Patent: Jan. 13, 2009

(54) GAME BASE SYSTEM

(75) Inventor: Greg Boesch, San Mateo, CA (US)

(73) Assignee: GB Sports, LLC, San Mateo, CA (US)

( * ) Notice: Subject to any disclaimer, the term of this patent is extended or adjusted under 35 U.S.C. 154(b) by 0 days.

(21) Appl. No.: 11/546,267

(22) Filed: Oct. 10, 2006

(65) Prior Publication Data

US 2007/0082761 A1 Apr. 12, 2007

Related U.S. Application Data

(60) Provisional application No. 60/725,401, filed on Oct. 11, 2005.

(51) Int. Cl.
*A63B 69/00* (2006.01)
*A63B 71/00* (2006.01)

(52) U.S. Cl. ..... 473/499; 473/500

(58) Field of Classification Search ..... 473/499, 473/500, 497, 501

See application file for complete search history.

(56) References Cited

U.S. PATENT DOCUMENTS 727,633 A * 5/1903 Humphreys ..... 473/500
2,440,042 A * 4/1948 Friedman ..... 473/500
3,181,863 A * 5/1965 Nellermoe ..... 473/499
3,330,053 A * 7/1967 Hendrix ..... 434/188
3,341,199 A 9/1967 Madsen
3,938,804 A 2/1976 Willett
4,493,486 A 1/1985 Fuller et al.
5,401,016 A * 3/1995 Heglund et al. ..... 473/455
5,564,695 A * 10/1996 Christensen ..... 473/501
6,296,584 B1 * 10/2001 West et al. ..... 473/499
D479,295 S 9/2003 Vesledahl
7,175,550 B1 2/2007 Bellah, Jr. et al.
7,270,616 B1 * 9/2007 Snyder ..... 473/453
2002/0096832 A1 * 7/2002 Severson ..... 273/444
2002/0142868 A1 10/2002 Nimmons
2004/0005942 A1 * 1/2004 Wang ..... 473/500

* cited by examiner

*Primary Examiner*—Mitra Aryanpour
(74) *Attorney, Agent, or Firm*—Perkins Coie LLP

(57) ABSTRACT

A technique for improving the safety of a sport with bases involves providing a variety of indicia. The indicia can be associated with portions of the base to facilitate safe base running.

17 Claims, 12 Drawing Sheets

GAME BASE SYSTEM

This application claims the benefit of U.S. Provisional Patent Application No. 60/725,401, entitled A CODE FOR USE WITH GAME BASES, filed on Oct. 11, 2005, which is incorporated herein by reference.

BACKGROUND

The foregoing examples of the related art and limitations related therewith are intended to be illustrative and not exclusive. Other limitations of the related art will become apparent to those of skill in the art upon a reading of the specification and a study of the drawings.

Baseball is an American pastime. For years, children and adults of all ages have enjoyed the game. From the smell of fresh cut grass in the morning to the feel of a soft supple leather glove that has been used for years, the game is a part of who we are. It has even grown to incorporate aspects from other known sports, such as cricket, and to expand into new sports, such as softball and kickball. However, even in all its glory, baseball, as well as its predecessor contributors and descendent sports, has its drawbacks.

A particularly dangerous aspect of the game is base running. The fundamental flaw is inherent in the design of the game. After a batter hits the ball, the object of the game is to run toward first base to try and beat out the ball. However, a defensive player must stand on first base in order to receive the ball in order to get the hitter out. Often this leads to injury as the players collide because no guidelines exist as to where each player should be on the base. In addition, once a batter hits the ball, the batter is often instructed not to look at the ball and concentrate on running. The coach is supposed to instruct the batter whether to advance or run through the base. If the communication is ineffective, the player is left confused and unsure of what to do.

SUMMARY

The following embodiments and aspects thereof are described and illustrated in conjunction with systems, tools, and methods that are meant to be exemplary and illustrative, not limiting in scope. In various embodiments, one or more of the above-described problems have been reduced or eliminated, while other embodiments are directed to other improvements.

A technique for improving the safety of a sport with bases involves providing a variety of indicia. An example of a device according to the technique includes a base with associated indicia. The indicia can be associated with portions of the base to facilitate safe base running. In an exemplary but non-limiting embodiment, a base is provided with associated indicium. By way of example and not limitation, the indicium may be associated with a portion of the base, and may comprise a plurality of aesthetic elements. In other embodiments, a base and indicia may serve a functional purpose for participating in a variety of sports, not necessarily requiring base traversal or base defense.

In an exemplary but non-limiting embodiment, a first indicium associated with the base is an image indicating a first direction. In some example embodiments, a direction is indicated by an arrow. In another exemplary but non-limiting embodiment, a second indicium is associated with the base and may comprise an image indicating a second direction. In a further exemplary but non-limiting embodiment, a third indicium associated with the base may indicate a position for a defensive player to stand. In another exemplary but non-limiting embodiment, said indicia are of different colors. Thus, participation in sports involving at least one base is functionally improved.

These and other advantages of the present invention will become apparent to those skilled in the art upon a reading of the following descriptions and a study of the several figures of the drawings.

BRIEF DESCRIPTION OF DRAWINGS

Embodiments of the invention are illustrated in the figures. However, the embodiments and figures are illustrative rather than limiting; they provide examples of the invention.

DETAILED DESCRIPTION

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments, of the invention.

It will be readily understood that the embodiments described are not limited in applicability to any particular sport. As such embodiments may be applied in any activity or sport, including those in which participants traverse or otherwise use bases. By way of example and not limitation baseball, softball, cricket, kickball, forms of dodge ball, as well as modified versions of these sports.

Figure 1:
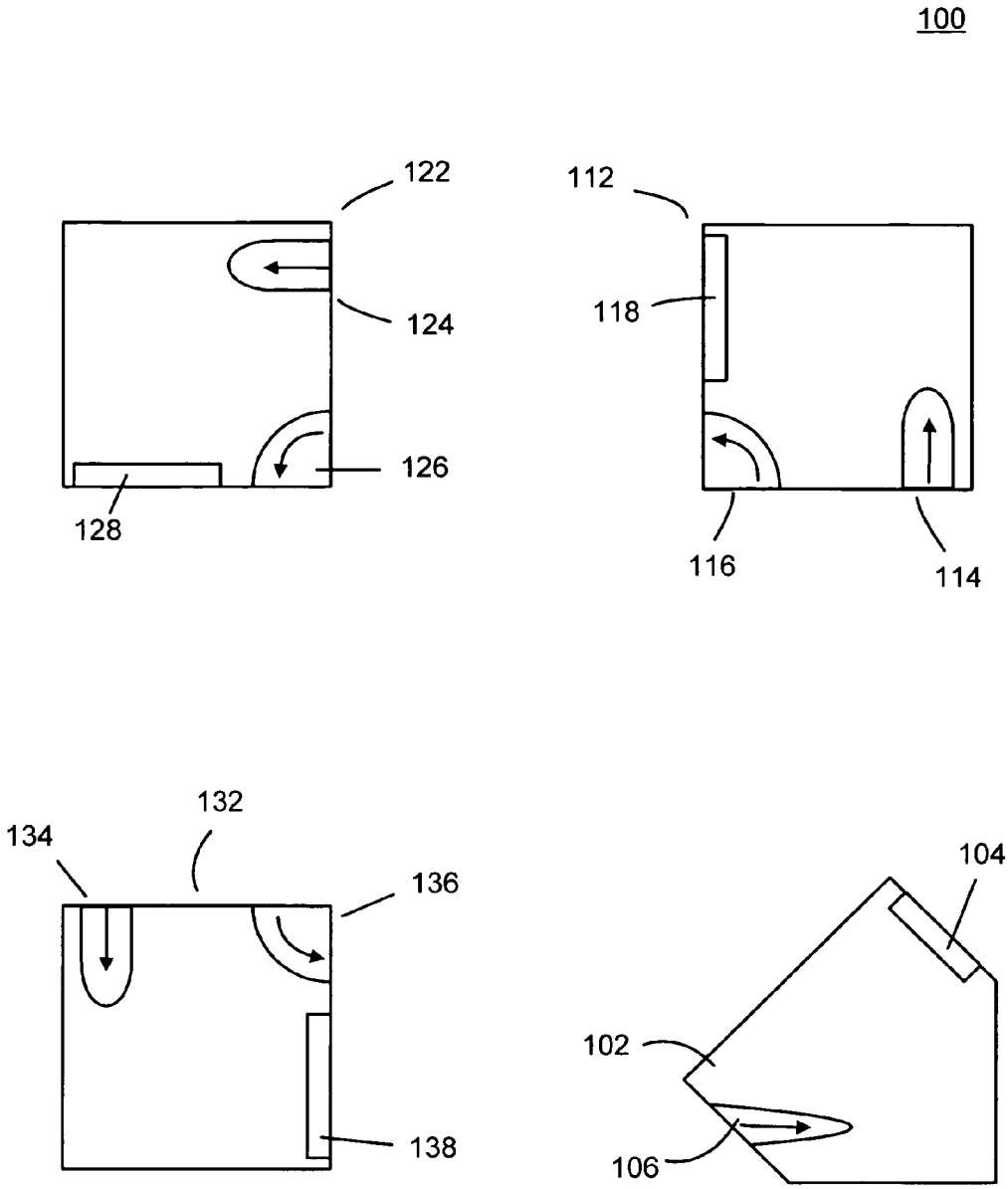
FIG. 1 depicts a sports field with coded bases.

FIG. 1 depicts an example of a device 100 that may be used in playing a sport. In the example of FIG. 1, the device includes a home plate 102, on the home plate 102 a first indicium 104, a second indicium 106, a first base 112, on the a first base a first indicium 114, a second indicium 116, a third indicium 118, a second base 122, on the second base a first indicium 124, a second indicium 126, a third indicium 128, a third base 132, on the third base a first indicium 134, a second indicium 136, and a third indicium 138.

The first base 112 has three indicia. The first indicium 114 indicates a first direction while a second indicium 116 indicates a second direction. The first indicium 114 is a straight arrow. In other example embodiments, a first indicium is the shape of a footprint. The second indicium 116 is a curved arrow which in use is to be pointing toward the second base 122. The third indicium 118 indicates a place to stand. In further example embodiments, the second indicium can be the size of a sport-related ball such as, by way of example and not limitation, a baseball, a softball, a kickball, a dodge ball, or any other sport-related ball wherein the sport employs bases.

The second base 122 has three indicia. The first second base indicium 124 is a straight arrow. The second indicium 126 is a curved arrow which points toward third base 116. The third second base indicium 128 indicates a place to stand.

Third base 132 has three indicia. The first third base indicium 134 is a straight arrow. The second indicium 136 is a curved arrow which points toward home plate 102. The third indicium 128 indicates a place to stand.

An example of the device in use is provided in regard to baseball. However, the device may be used in a variety of activities. According to the rules of baseball, and an exemplary embodiment, after a batter hits a pitch the batter runs towards the first base 112. In one example embodiment, the first indicium 106 is used to guide the runner to run through the first base 112. The defensive player stands on, abutting, or near the third indicium 118. As such, the offensive and defensive players avoid contact because the indicia provide guidelines for the positioning of both players on the base. In another example embodiment, the first indicia 114, the second indicia 116, and the third indicia each are a different color. In this example embodiment, after the batter hits the pitch, a coach may communicate a color to the runner which corresponding to the indicia 114, 116, or 118. The runner may run according to the corresponding indicium without looking for the ball. For example, communicating the color corresponding to the first indicium 114 will tell the runner to stop at the first base 112. In an additional example, the coach communicating the color corresponding to the second indicium 116 may tell the runner to round the base and continue running toward the second base 122.

In a further example embodiment, a runner runs past the first base 112 and rounds to the second base 122. According to this embodiment, the coach may communicate a second color corresponding to the indicia 124, 126, 128. According to this embodiment, the runner may head toward second base without looking for the ball. In an example embodiments, a defensive player may stand on the third indicium 128, allowing the runner to follow the first indicium 124 and/or second indicium 126 (depending on the hit and/or decision of the coach), thereby avoiding contact with the defensive players, and increasing the safety of base running.

In additional example embodiments, the coded bases may be made of any convenient and/or known material, including, by way of example and not limitation, plastic, rubber, acrylic, paper, wood, leather, steel, glass, thread, rope, string, cotton, silk, tweed, polyester, rayon, or any other flexible or inflexible, removable or permanent material that can be used as a base. Further, in alternate example embodiments, the indicia can be associated on any part of the base using any convenient and/or known manner, including, by way of example and not limitation, any convenient and/or known adhesive device, removable or non-removable. For example, the indicia can be fabricated as part of a cover which is placed over the base.

In another example embodiment, the indicia are manufactured as part of the base or are embedded within the material of the base using any convenient and/or known device and/or method. The indicia may be depicted using one or any number of images. Furthermore, the images depicting the indicia can vary widely in shape, color, size, and design. By way of example and not limitation, this can include any animal, human, creature, cartoon figure, shape, form, sign, representation, icon, mark, emblem, or any other picture, drawing, sketch, design, symbol, device or customizable contrivance that indicates or does not indicate a direction. Moreover, in alternate embodiments, the indicia do not contain arrows or any other directional indicators and can use any known and/or convenient method to communicate an instruction.

In an example embodiment, the positioning of the indicia may be in any convenient and/or known manner. For example, the indicia for direction can be on any side and the indicia indicating position can be on any side. Moreover, the indicia can be in any known and/or convenient combination on the base or any other known and/or convenient surface. Further, in other embodiments, one or more the indicia can be removed and/or added according to preference. In another embodiment, the base can be removed and the indicia placed on the ground or on any other known and/or convenient surface. In additional embodiments, the bases could be used by themselves or with any number of other bases and can represent any base, including home plate. Further, the bases can be coupled to stakes in the grounds or laid on the ground. Moreover, the bases can be any variety of thickness ranging from immobile to thin sheets.

Figure 2:
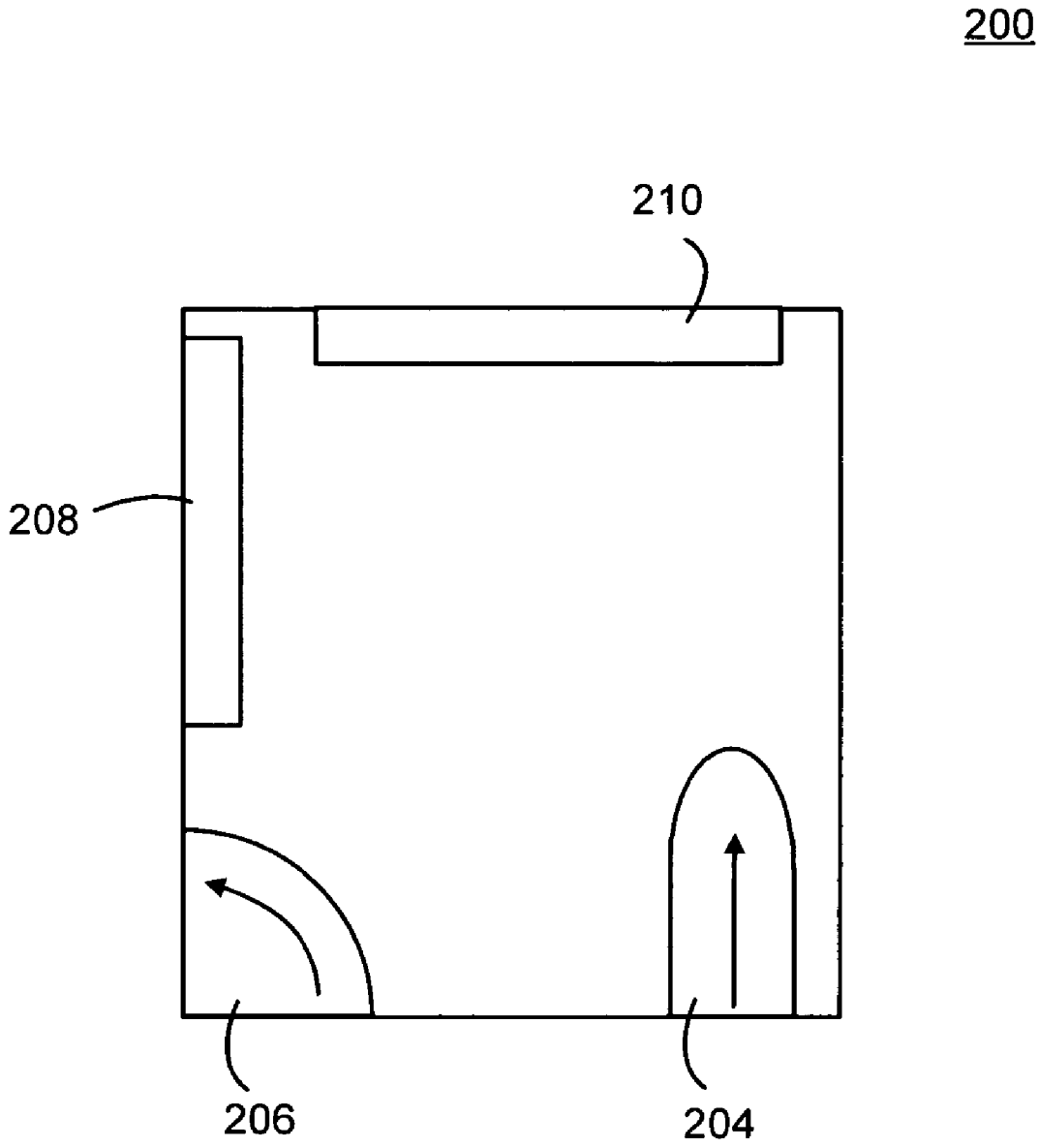
FIG. 2 depicts a coded base with four indicia.

FIG. 2 depicts a coded base 200 with a first indicium 204, a second indicium 206, a third indicium 208, and a fourth indicium 210. In the example embodiment shown, the first indicium 204 indicates a first direction while a second indicium 206 indicates a second direction. In alternate example embodiment, the first indicium 204 and the second indicium 206 may be any known and/or convenient direction and/or color. Further, the third indicium 208 indicates a first standing position and the fourth indicium 210 indicates a second standing position. As shown in the example of FIG. 2, the indicia can be in a variety of positions depending on a variety of factors. Furthermore, indicia can be added or removed and used to indicate any known and/or convenient communication or instruction.

Figure 3:
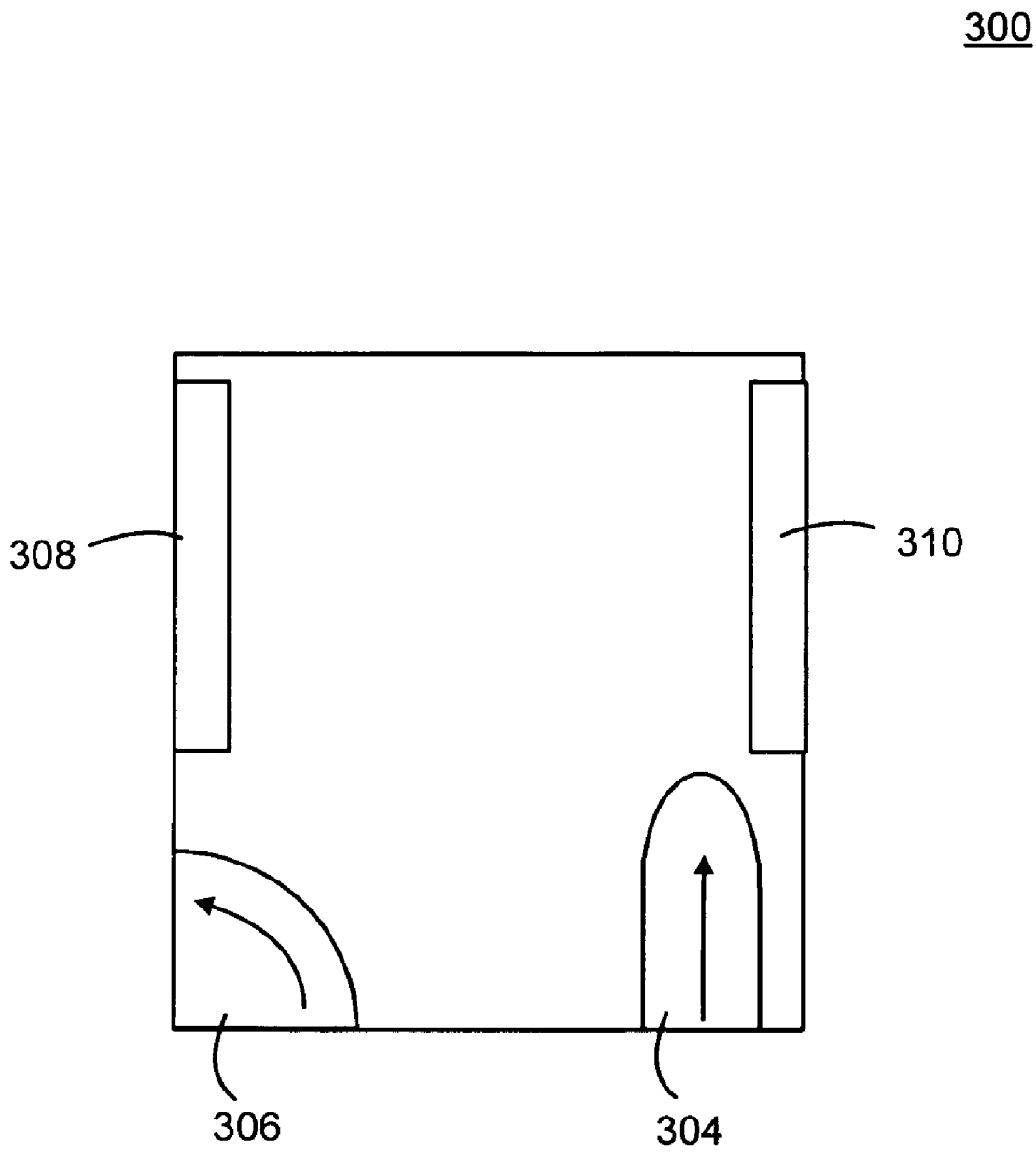
FIG. 3 depicts an alternate embodiment of a coded base with four indicia.

FIG. 3 depicts a coded base 300 with a first indicium 304, a second indicium 306, a third indicium 308, and a fourth indicium 310. In the example embodiment shown, the first indicium 304 indicates a first direction while the second indicium 306 indicates a second direction. In an alternate example embodiment, the first indicium and second indicium may be any known and/or convenient direction and/or color. The third indicium 308 indicates a first standing position and the fourth indicium 310 indicates a second standing position. As shown in the example of FIG. 3, the indicia can be in a variety of positions depending on a variety of factors. For example, the indicia can be in such a way that a player straddles the base in order to effectively tag an offensive player out. Moreover, the indicia can be different colors corresponding to different positions. For example, on second base, the indicia can be one color for the second base man and another for the shortstop. Furthermore, indicia can be added or removed and/or used to indicate any known and/or convenient communication or instruction.

Figure 4:
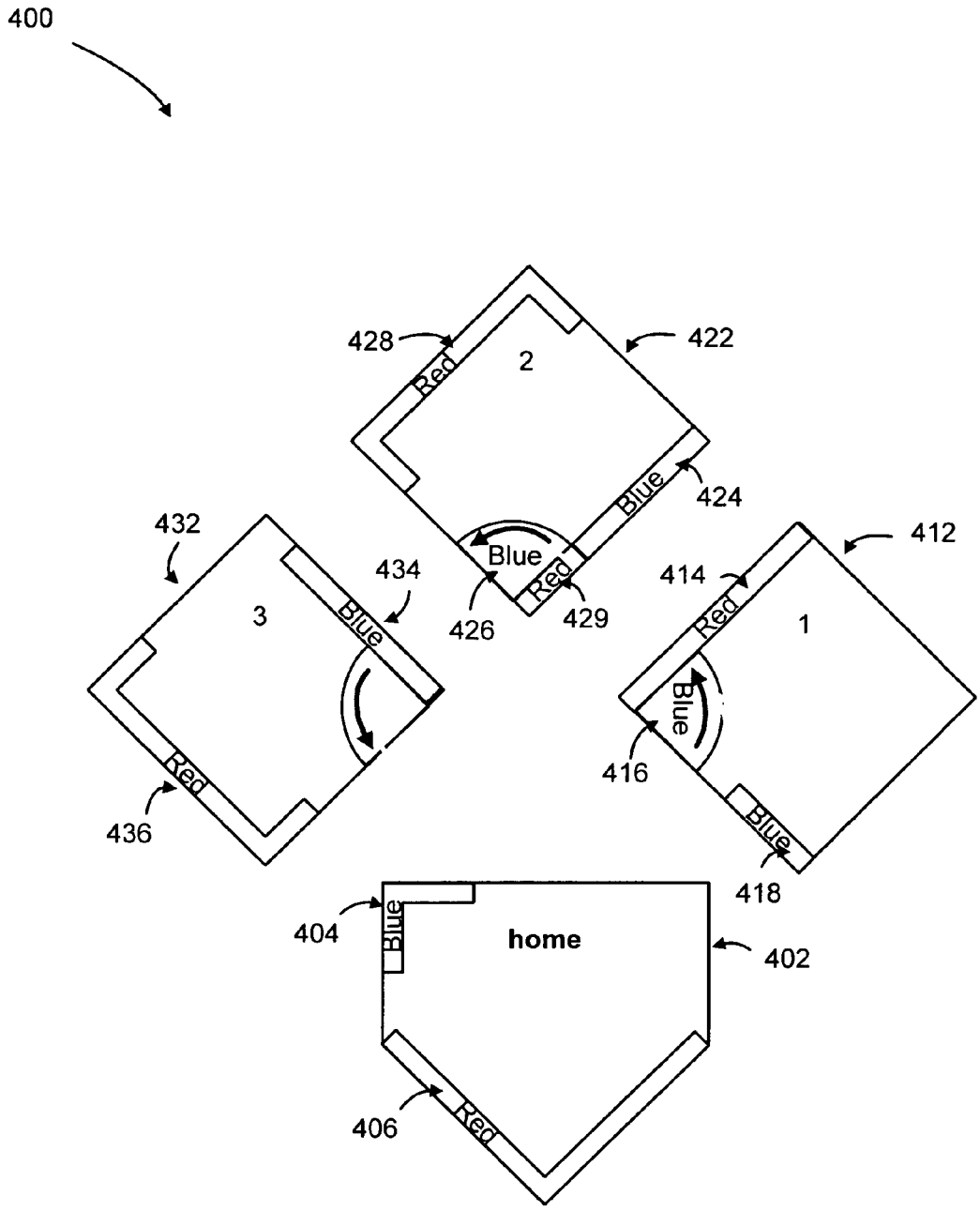
FIG. 4 depicts an alternate embodiment of four coded bases.
Figure 5:
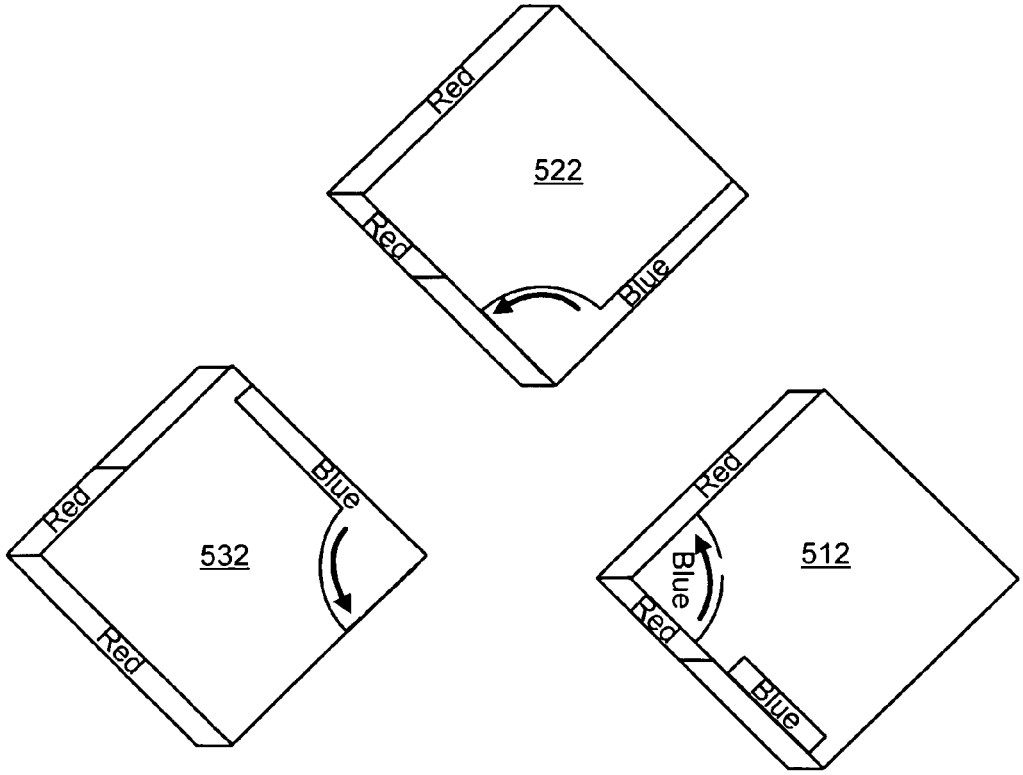
FIG. 5 depicts an alternative embodiment of three coded bases.
Figure 6:
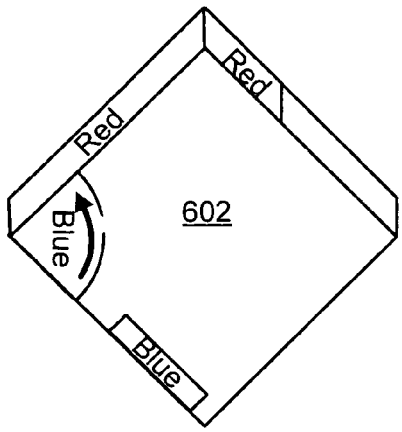
FIG. 6 depicts an alternative embodiment of three coded bases.
Figure 7:
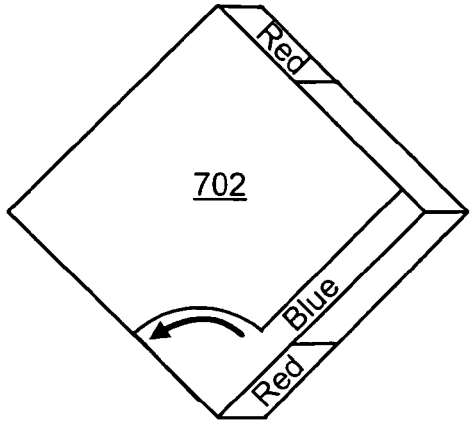
FIG. 7 depicts an alternative embodiment of three coded bases.
Figure 8:
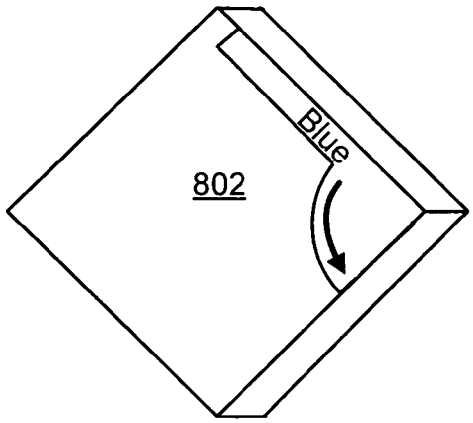
FIG. 8 depicts an alternative embodiment of three coded bases.
Figure 9:
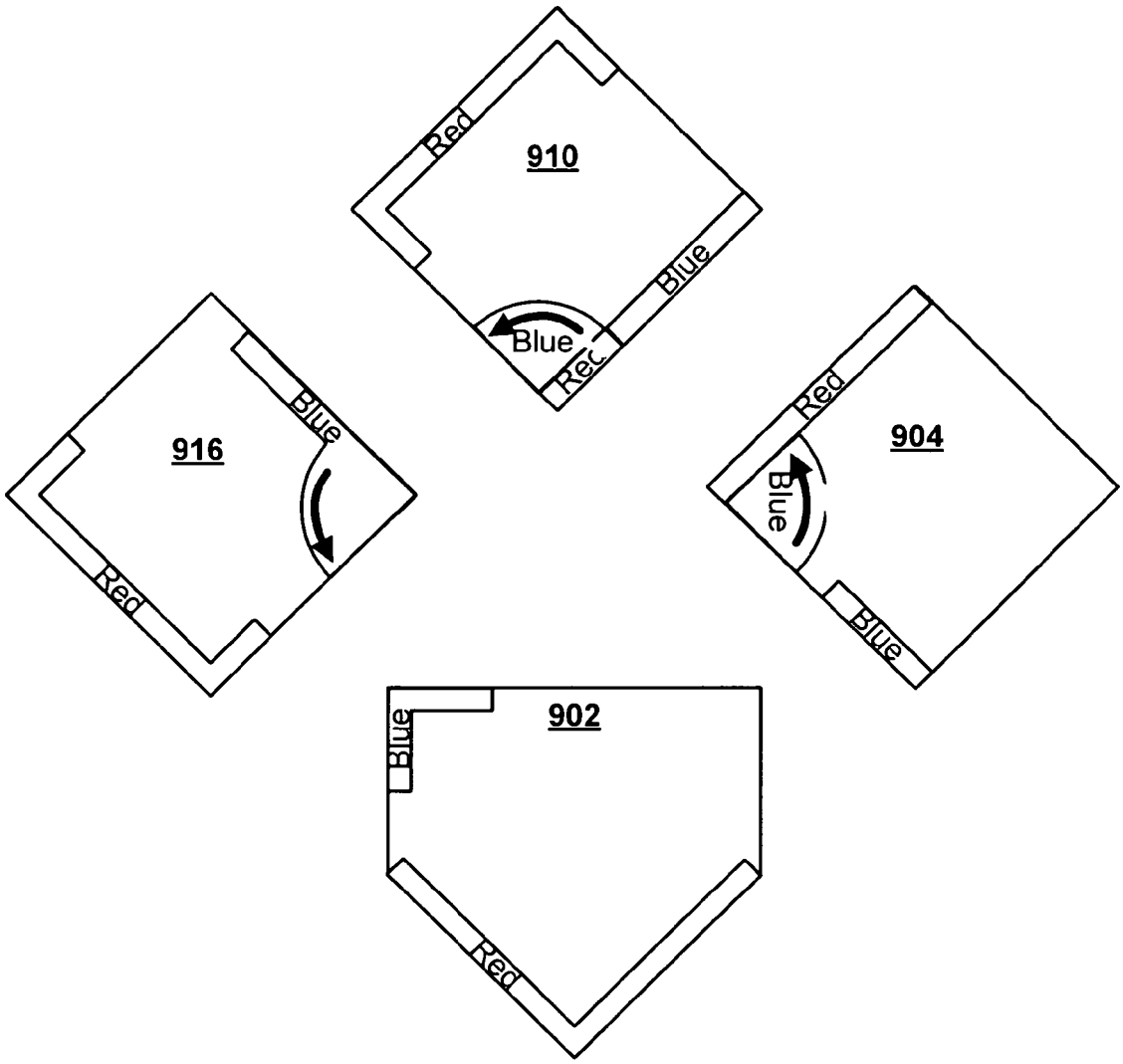
FIG. 9 depicts an alternative embodiment of three coded bases.
Figure 10:
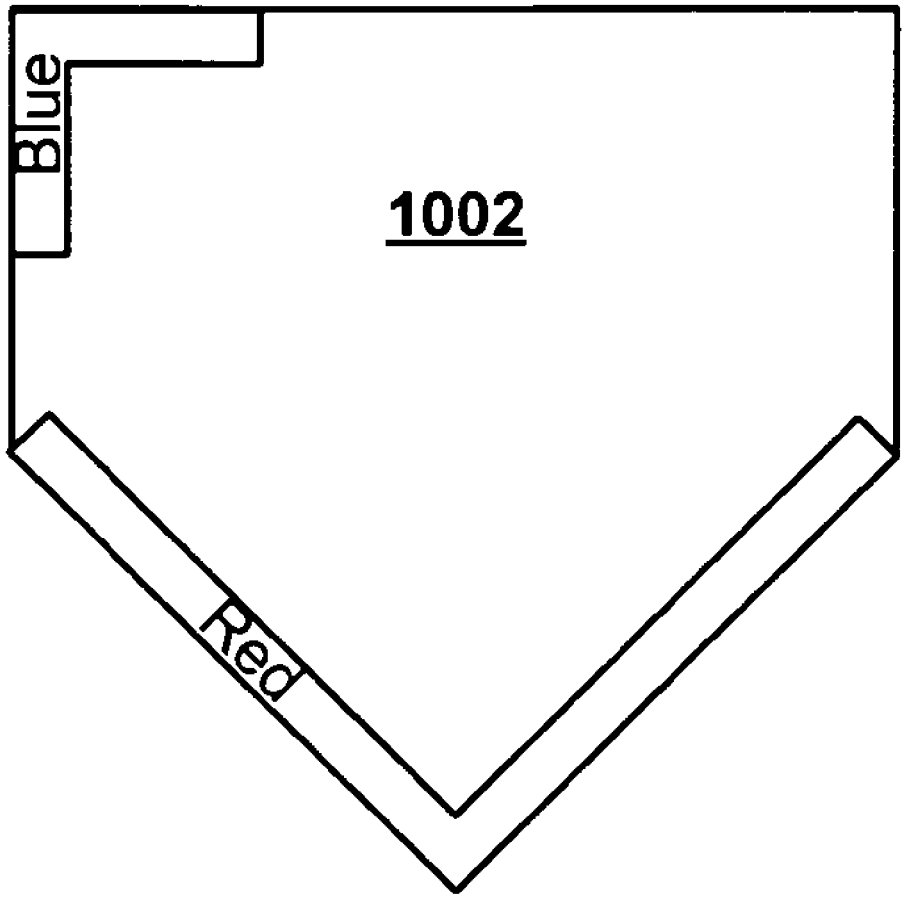
FIG. 10 depicts an alternative embodiment of three coded bases.
Figure 11:
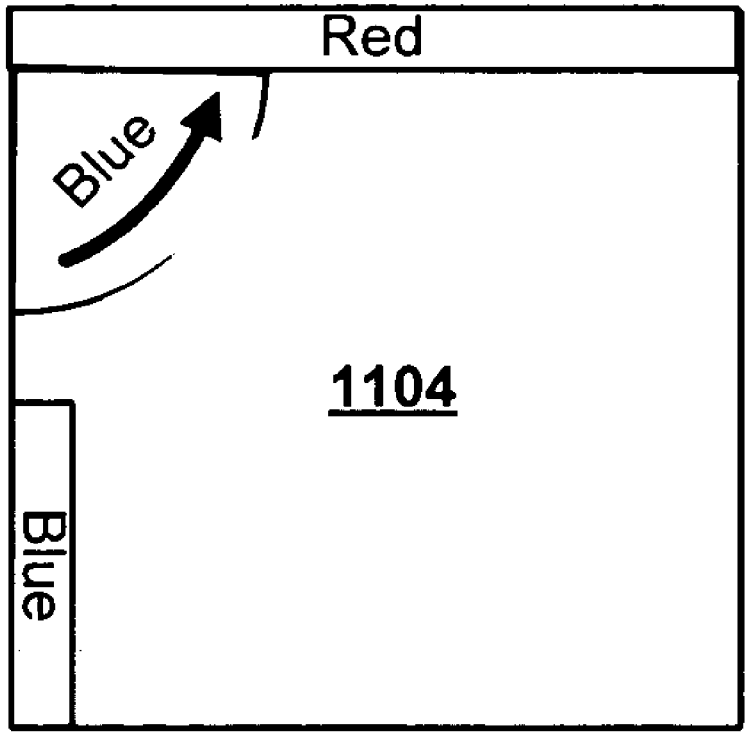
FIG. 11 depicts an alternative embodiment of three coded bases.
Figure 12:
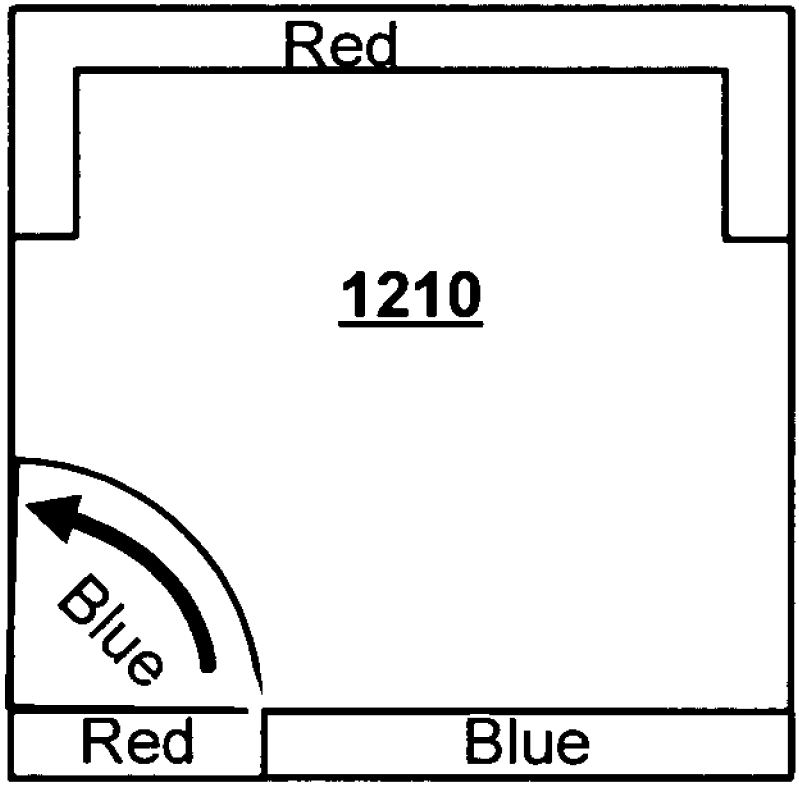
FIG. 12 depicts an alternative embodiment of three coded bases.
Figure 13:
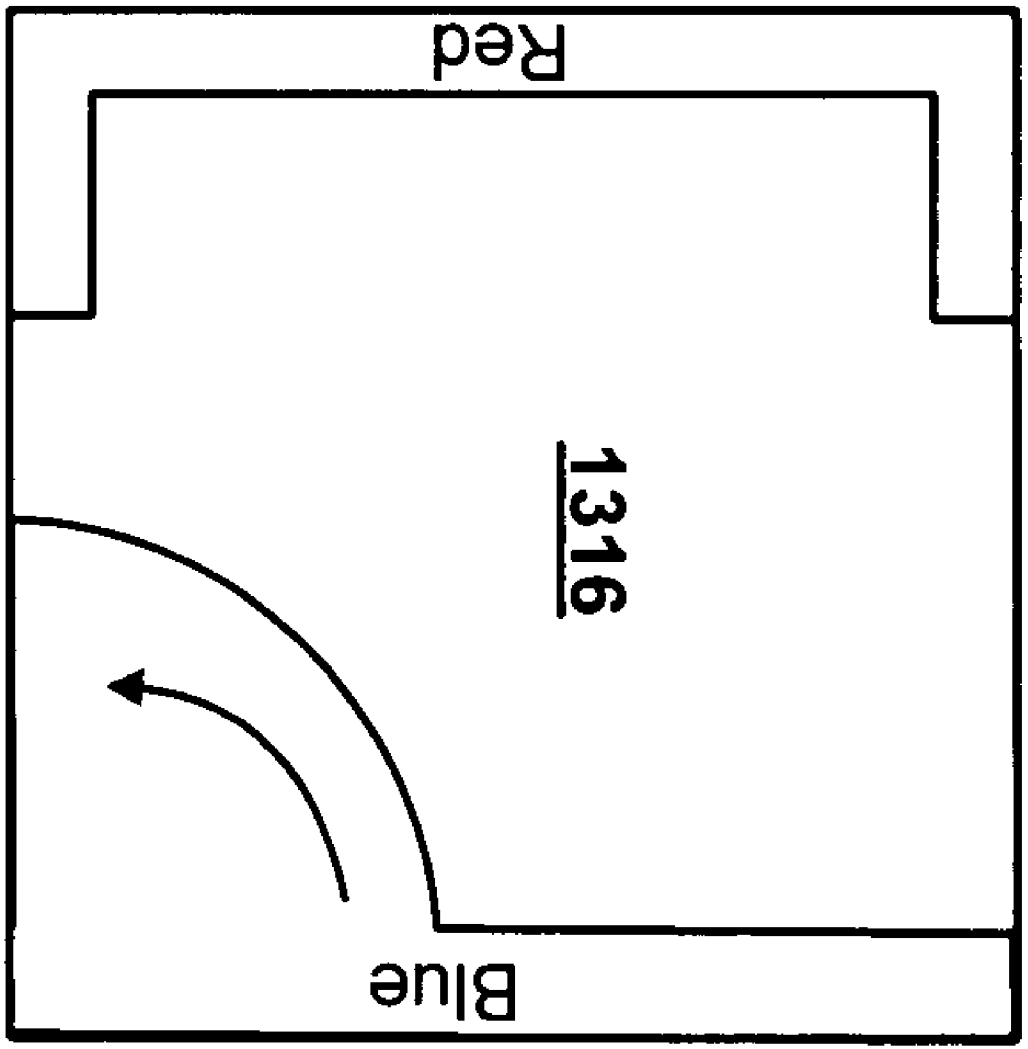
FIG. 13 depicts an alternative embodiment of three coded bases.

FIG. 4 depicts an alternate example embodiment of four coded bases. In the example of FIG. 4 a sports field 400 such as, by way of example and not limitation, a baseball field, a softball field, or a kickball field with coded bases. As shown in the embodiment illustrated, sports field 400 includes a home plate 402, on the home plate 402 a first indicium 404, a second indicium 406, a first base 412, on the first base a first indicium 414, a second indicium 416, a third indicium 418, a second base 422, on the second base a first indicium 424, a second indicium 426, a third indicium 428, a fourth indicium 429, a third base 432, on the third base a first indicium 434, and a second indicium 436.

In the example of FIG. 4, first base 412 includes a first indicium 414, a second indicium 416, and a third indicium 418. Indicia 414 and 416, respectively, communicate a lead off position and a rounding position through which associated base runners may be directed or taught to traverse first base in accordance with a selection of strategies or training exercises of a sports team. Indicium 416 is a curved arrow and communicating the direction in which associated base runners may be directed to run around the first base 412 to the second base 422. Indicium 418 communicates a position in which associated defensive players should stand.

In the example of FIG. 4, the indicia 414 and 416 are both blue in color and associated with base runner positions. Further, in the example of FIG. 4, the red color of indicium 418 communicates a defensive player's suggested standing position. Also, in the example of FIG. 4, indicium 414 indicates a position through which an associated base runner may traverse the first base 404.

In the example of FIG. 4, the second base 422 has a first indicium 424, a second indicium 426, a third indicium 428, and a fourth indicium 429. Indicia 424 and 426 on the second base 422 may be respectively similar to the two base runner indicia 414 and 416 on the first base 412. The base runner indicia 424 and 426 on the second base 422 share the same color, position, and directive features as the base runner indicia 414 and 416 on the first base 404. The indicia 428 and 429 on the second base 422 share the same red color as the indicium 418 on the first base 412.

In the example of FIG. 4, the second base 422 has a fourth indicium 429 which communicates a second standing position for a defensive player. In one example embodiment, the fourth second base indicium 429 is positioned in such a way that a defensive player straddles the base in order to effectively tag a runner.

In the example of FIG. 4, the third base 432 has two indicia. As shown in the example of FIG. 4, the third base 432 includes a first indicium 434 which is used by a base runner. The first indicium 434 may, by way of example and not limitation, communicate, by way of an arrow, a route through which a base runner is commanded or trained to round a third base toward home plate. As further shown in the example of FIG. 4, a position toward which a base runner is commanded or trained to travel if not continuing on to the home plate 402 in illustrated by way of a blue-colored bar. Third base 432 has an indicium 436, which may be similar to the single defensive player indicium 418. Indicium 436 communicates, by way of a red color, a range of positions in which a defensive player is commanded or trained to stand.

In the example of FIG. 4, the home plate 402 contains two indicia 404 and 406. Indicia 404 and 406, respectively, communicate positions in which associated defensive players should stand and through which associated base runners should traverse home plate.

However, unlike indicia 128 and 130 in FIG. 1, indicia 428 and 430 are colored specifically and respectively red and blue, located in different positions, and do not represent one or more directions or depict one or more arrows. Indicium 428, by way of one color red, is associated with a defensive player. Indicium 430, by way of another color blue, is associated with a base runner. In some example embodiments, any combination of colors can be associated with the base runner or the defensive player. Indicia 428 and 430, compared with indicia 128 and 130, occupy different portions of the respective home plates 402 and 102 containing them. Such various placements of the indicia, may, in one embodiment correspond to the selection of strategies or training exercises of a sports team.

In the example of FIG. 4, the indicia of the bases 402, 412, 422, and 432 can take virtually any form that serves a functional purpose for a participant in a sport that involves traversing one or more bases. As shown in the embodiments illustrated by FIG. 4, the indicia can be in a variety of positions depending on a variety of factors. For example, the indicia can be in such a way that a player straddles the base in order to effectively tag an offensive player out. The indicia on a base may have any known and/or convenient direction and/or color. Moreover, the indicia can be different colors corresponding to different positions. For example, on a second base, the indicia can be one color for a second base man and another for a shortstop. Furthermore, indicia may be added or removed and/or used to indicate any known and/or convenient communication or instruction.

The examples of FIGS. 5, 6, 7, and 8 depict photographs of alternative example embodiments of bases comprising one or more indicia.

The example of FIGS. 9, 10, 11, 12, and 13 depict photographs of alternative example embodiments of bases comprising one or more indicia.

The examples depicted in FIGS. 5 through 8 and the examples depicted in FIGS. 9 through 13 illustrate alternative example embodiments respectively comprising two different materials and forms of indicia. The material composing the bases in FIGS. 5 through 8 is more flexible, thicker, heavier, and permanent than the material of the bases in FIGS. 9 through 13, which is less flexible, thinner, lighter, and disposable. The form of indicia contained on the bases in FIGS. 5 through 8 is non-adhesive, non-removable, and inextricably embedded whereas the form of indicia contained on the bases in FIGS. 9 through 13 is adhesive, removable, and separately manufactured. In some example embodiments, the coded bases can be made of any convenient and/or known material, including, by way of example and not limitation, plastic, rubber, acrylic, paper, wood, leather, steel, glass, thread, rope, string, cotton, silk, tweed, polyester, rayon, or any other flexible or inflexible, removable or permanent material that can be used as a base. In some example embodiments, indicia may be associated on any part of the base using any convenient and/or known manner, including, by way of example and not limitation, any convenient and/or known adhesive device, removable or non-removable. By way of non-limiting example, they additionally demonstrate that indicia can be manufactured as part of the base or can be embedded within the material of the base using any convenient and/or known device and/or method.

In additional example embodiments, a base may have varying uses depending on the rules of the particular game. For example, in baseball or softball, the play can start by a batter hitting a pitch. In one embodiment the coach can yell to the batter the color of the appropriate indicium. If the ball is hit far, the coach would yell the color of the indicium that corresponds to the batter rounding first base and heading toward second base. On the other hand, if the ball is not hit far, the coach can yell the color of the indicium that corresponds to the batter running through first base. Further, the coach from the opposing team can also yell a color depending on where the ball is hit. For example, as above, if the ball is hit far, the offensive coach would yell the color of the indicium corresponding to the batter rounding first base and heading toward second base. The defensive coach can then yell a color of the indicium corresponding to a standing position on second base. This color would be recognizable to either the shortstop or the second baseman, and the correct player can run toward the base to make the play. In further embodiments, the offensive coach can yell a color of the indicium corresponding to having the batter stay at second base, run through second base (depending on the rules of the game), or run around the bag toward third base. Moreover, if the ball is hit very far, the offensive coach can yell a color of an indicium corresponding to the batter rounding first base, second base and/or third base and/or heading for home plate to score a homerun.

In some example embodiments, the indicia used in the bases may include a light element to communicate with the base runner or defensive player. In this example embodiment a person could signal to the base runner through a light element included in the indicia and activated by a signal to the base. Example of possible light elements includes LEDs, florescent lights, incandescent lights, or any other light source known or convenient. For example, the coach could hit a switch to automatically signal to the base runner to either stop at the base or continue running. The light element could be activated through a signal over a wire, through a radio transmission, voice activated, or any other transmission know or convenient.

Figure 14:
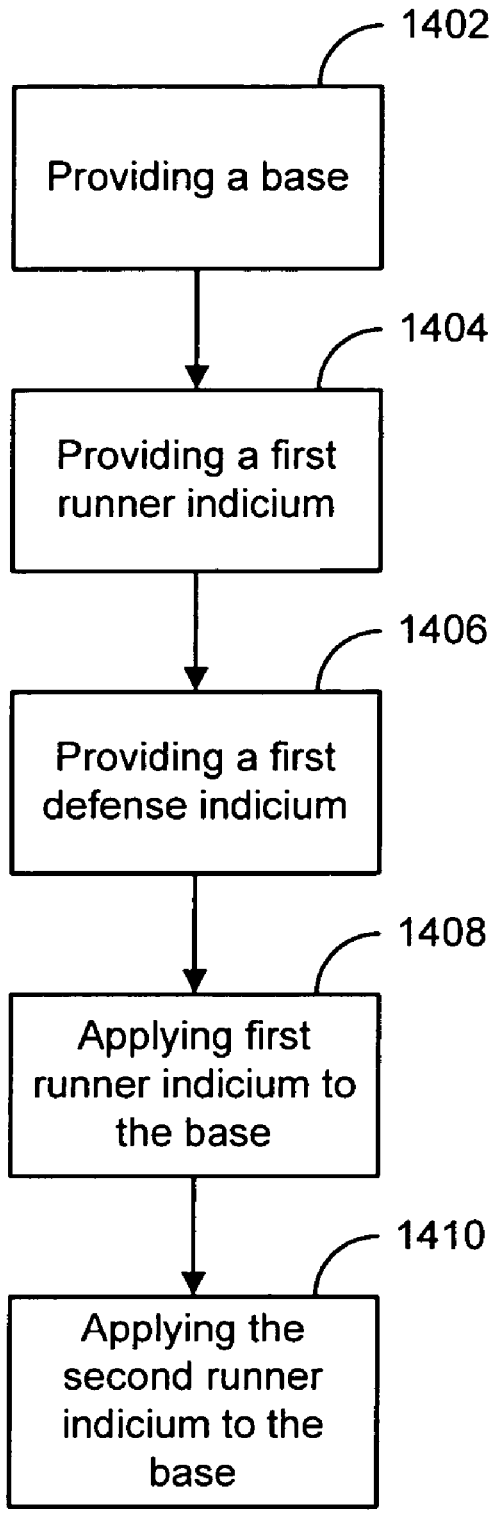
FIG. 14 depicts a flowchart of an example method of creating a coded base.

In the example of FIG. 14, an example flowchart of a method or creating a coded base is depicted. Block 1402 depicts providing a base. In some example embodiments, the base may be a regulation base for a particular sport, a specially created base, a piece or wood, a piece of cardboard or any other material known or convenient. Block 1404 depicts providing a runner indicium. In some example embodiments, a runner indicium may be a decal, a sticker, tape, button, patch, or any other item known or convenient. Block 1406 depicts providing a defense indicium. In some example embodiments, a defense indicium may be a decal, a sticker, tape, button, patch, or any other item known or convenient. Block 1406 depicts applying the runner indicium to the base in manner which would make it visible to a base runner during a game. The runner indicium can be attached via glue, tape, thread, Velcro, pins, nails, or any other way known or convenient. Block 1408 depicts applying the defense indicium to the base in manner which would make it visible to a defensive player during a game. The runner indicium can be attached via glue, tape, thread, Velcro, pins, nails, or any other way known or convenient.

In one embodiment, a base apparatus may be used for training purposes. For example, and not limitation, the base apparatus may have marking indicating the proper running technique for baseball. A base runner can be trained, for example and not limitation, to round first base by step on the inside corner of the base which is marked accordingly. The comer of the base is marked for a variety of reasons, including but not limited to, the quickest traversal of the base. In another embodiment, the base apparatus can allow coaches to properly train the players by showing and reminding the players of the markings. In a further example, the bases can be turned over and/or the marking removed in order to test the learned skills of the players.

As used herein, the term "embodiment" means an embodiment that serves to illustrate by way of example but not limitation.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. A system for use in a sport with bases comprising:

a first element including:

a first substratum;

a first overlay coupled to the substratum, the first overlay having a first element including a first runner indicium suited to indicate a first direction to a base runner and a first defense indicium suited to indicate a first position, the first runner indicium suited to indicate the first direction to a base runner so as to avoid collision with a first defensive player at the first position, the first runner indicium is visible to the base runner, the first defense indicium is visible to the first defensive player;

a first anchoring mechanism connected to the substratum, wherein, in operation, the first anchoring mechanism keeps the first overlay in a static orientation such that the first runner indicium remains suited to indicate the first direction and the first defensive indicium remains suited to indicate the first position;

a second element including:

a second substratum;

a second overlay coupled to the substratum, the second overlay having a second element including a second runner indicium suited to indicate a second direction to the base runner and a second defense indicium suited to indicate a second position, the second runner indicium suited to indicate the second direction to the base runner so as to avoid collision with a second defensive player at the second position, the second runner indicium is visible to the base runner, the second defense indicium is visible to the first defensive player;

a second anchoring mechanism connected to the substratum, wherein, in operation, the second anchoring mechanism keeps the second overlay in a static orientation such that the second runner indicium remains suited to indicate the second direction and the second defensive indicium remains suited to indicate the second position;

a third element including:

a third substratum;

a third overlay coupled to the substratum, the third overlay having a third element including a third runner indicium suited to indicate a third direction to a base runner and a third defense indicium suited to indicate a first position, the third runner indicium suited to indicate the third direction to the base runner so as to avoid collision with a third defensive player at the third position, the third runner indicium is visible to the base runner, the third defense indicium is visible to the third defensive player;

a third anchoring mechanism connected to the substratum, wherein, in operation, the third anchoring mechanism keeps the third overlay in a static orientation such that the third runner indicium remains suited to indicate the third direction and the third defensive indicium remains suited to indicate the third position;

a fourth element including a home plate;

wherein, in operation, the first, second, third and fourth elements are positioned consistent with the location of bases and a home plate used in a sport, such that a first line from the fourth element to the first element is substantially perpendicular to a second line from the first element to the second element, the first line is substantially parallel to a third line from the second element to the third element, and the first line is substantially perpendicular to a fourth line from the third element to the fourth element;

wherein the first runner indicium of the first overlay is different from the second runner indicium of the second overlay and the first runner indicium of the first overly is different from the third runner indicium of the third overlay;

wherein the second defense indicium of the second overlay is different from the first defense indicium of the first overlay and the second defense indicium of the second overlay is different from the third defense indicium of the third overlay.

2. The system of claim 1, wherein the first element serves as a first base, the second element serves as a second base, the third element serves as a third base, and the fourth element serves as home plate on a baseball diamond.

3. The system of claim 1, wherein the first runner indicium and the first defense indicium are different colors.

4. The system of claim 1, the second element includes a fifth defense indicium suited to include a fifth position, the second runner indicium suited to indicate the second direction to the base runner so as to avoid collision with a fifth defensive player at the fifth position, the fifth defense indicium is visible to the fifth defensive player.

5. The system of claim 1, wherein the first runner indicium is an illustrative diagram.

6. The system of claim 1, further comprising a light producing means, wherein touching a portion of the first runner indicium causes the light producing means to generate a light.

7. The system of claim 1, further comprising a sound producing means, wherein touching a portion of the first runner indicium causes the sound producing means to generate a sound.

8. The system of claim 1, further comprising a light producing means, wherein touching a portion of the first defense indicium causes the light producing means to generate a light.

9. The system of claim 1, further comprising a sound producing means, wherein touching a portion of the first defense indicium causes the sound producing means to generate a sound.

10. A system comprising:

a first overlay including a first runner indicium, indicating an offensive foot placement on the first runner indicium, the first runner indicium configured for visibility to a first base runner; a first defense indicium, indicating a defensive foot placement on the first defense indicium, the first defense indicium configured for visibility to a first defensive player;

a second overlay including a second runner indicium, indicating an offensive foot placement on the second runner indicium, the second runner indicium configured for visibility to a second base runner; a second defense indicium, indicating a defensive foot placement on the second defense indicium, the second defense indicium configured for visibility to a second defensive player;

a third overlay including a third runner indicium, indicating an offensive foot placement on the third runner indicium, the third runner indicium configured for visibility to a third base runner; a third defense indicium, indicating a defensive foot placement on the third defense indicium, the third defense indicium configured for visibility to a third defensive player;

wherein, in operation:

the first overlay is affixed to the substratum of a first base apparatus, and the first overlay is oriented over the first base apparatus such that the offensive foot placement and defensive foot placement are oriented to reduce risk of collision by the first base runner and the first defensive player when simultaneously touching the first base apparatus respectively at the first runner indicium and the first defense indicium;

the second overlay is affixed to the substratum of a second base apparatus, and the second overlay is oriented over the second base apparatus such that the offensive foot placement and defensive foot placement are oriented to reduce risk of collision by the second base runner and the second defensive player when simultaneously touching the second base apparatus respectively at the second runner indicium and the second defense indicium;

the third overlay is affixed to the substratum of a third base apparatus, and the third overlay is oriented over the third base apparatus such that the offensive foot placement and defensive foot placement are oriented to reduce risk of collision by the third base runner and the third defensive player when simultaneously touching the third base apparatus respectively at the third runner indicium and the third defense indicium;

wherein a first line segment from near the first base apparatus to near the second base apparatus forms a first leg of a right triangle, a second line segment from a near the second base apparatus to near the third base apparatus forms a second leg of the right triangle, and a third line segment from near the third base apparatus to near the first base apparatus forms a hypotenuse of the right triangle;

wherein the first runner indicium is different from the second runner indicium wherein the first runner indicium is different from the third runner indicium;

wherein the second defense indicium is different from the first defense indicium;

wherein the second defense indicium is different from the third defense indicium;

whereby safety associated with base-running is increased.

11. The system of claim 10, wherein the first runner indicium and the first defense indicium are different colors.

12. The system of claim 10, the second element includes a fifth defense indicium suited to include a fifth position, the second runner indicium suited to indicate the second direction to the base runner so as to avoid collision with a fifth defensive player at the fifth position, the fifth defense indicium is visible to the fifth defensive player.

13. The system of claim 10, wherein the first runner indicium is an illustrative diagram.

14. The system of claim 10, further comprising a light producing means, wherein touching a portion of the first runner indicium causes the light producing means to generate a light.

15. The system of claim 10, further comprising a sound producing means, wherein touching a portion of the first runner indicium causes the sound producing means to generate a sound.

16. The system of claim 10, further comprising a light producing means, wherein touching a portion of the first defense indicium causes the light producing means to generate a light.

17. The system of claim 10, further comprising a sound producing means, wherein touching a portion of the first defense indicium causes the sound producing means to generate a sound.

* * * * *